US006299032B1

(12) United States Patent
Hamilton

(10) Patent No.: US 6,299,032 B1
(45) Date of Patent: Oct. 9, 2001

(54) DISPOSABLE ACTUATOR WITH CAP OPENER FOR AEROSOL CANS

(76) Inventor: George W. Hamilton, 9420 Shoreview Rd., Dallas, TX (US) 75238

( * ) Notice: Subject to any disclaimer, the term of this patent is extended or adjusted under 35 U.S.C. 154(b) by 0 days.

(21) Appl. No.: 09/723,118

(22) Filed: Nov. 27, 2000

(51) Int. Cl.[7] ..... B65D 83/16
(52) U.S. Cl. ..... 222/402.15; 222/192
(58) Field of Search ..... 222/402.15, 192; 215/390, 391; 220/260, 284, 285

(56) References Cited

U.S. PATENT DOCUMENTS

| | | | | |
|---|---|---|---|---|
| 2,685,989 | * | 8/1954 | Samuels | 222/402.13 |
| 2,877,934 | * | 3/1959 | Wallace | 222/402.15 |
| 2,941,700 | * | 6/1960 | Gable | 222/402.15 |
| 3,096,002 | * | 7/1963 | Focht | 222/415.15 |
| 3,112,849 | * | 12/1963 | Wallace | 222/402.15 |
| 3,172,582 | * | 3/1965 | Belpedio | 222/473 |
| 3,317,092 | * | 5/1967 | Jursdek | 222/402.13 |
| 3,478,938 | * | 11/1969 | Krause | 222/402.14 |
| 3,611,820 | * | 10/1971 | Hempel | 74/102 |
| 3,967,763 | * | 7/1976 | Focht | 222/402.15 |
| 4,432,474 | * | 2/1984 | Hutchinson | 222/402.15 |
| 4,449,647 | * | 5/1984 | Reed | 222/153 |
| 5,323,937 | * | 6/1994 | Brody | 222/402.11 |
| 5,992,707 | * | 11/1999 | Galchuk | 222/402.13 |
| 5,992,708 | * | 11/1999 | Galchuk | 222/402.13 |
| 6,016,938 | * | 1/2000 | Elchorst | 222/402.15 |

* cited by examiner

*Primary Examiner*—Kevin Shaver
*Assistant Examiner*—Patrick Buechner

(57) ABSTRACT

An actuator for aerosol spray cans utilizing a toe, as a pivot point, to engage the inside recess on the cup rim bead of the can (the bead which surrounds the spray nozzle) and a heel portion that extends against the valve stem mount. The body and handle of the actuator extend from the toe and heel upward and over the spray nozzle of the can with the handle being positioned approximately perpendicular to the direction of the spray exhaust of the can. Spray action is initiated by depressing the handle of the actuator with forefinger or thumb, causing the toe of the actuator to act as a pivot in the inside recess of the cup rim bead and the heel to slide against the valve stem mount. A protrusion on the body of the actuator depresses the aerosol spray nozzle creating a spray exhaust.

The end of the actuator handle is formed to insert into the spray can cap and is used as a pry for removing the cap from the can.

6 Claims, 2 Drawing Sheets

DISPOSABLE ACTUATOR WITH CAP OPENER FOR AEROSOL CANS

CROSS-REFERENCE TO RELATED APPLICATIONS

| U.S. Pat. No. | Issued | Inventor | Search Field |
|---|---|---|---|
| 2877934 | 03/1959 | Wallace | 222/402.15 |
| 3096002 | 07/1963 | Focht | 222/402.15 |
| 3112849 | 12/1963 | Wallace | 222/402.15 |
| 3172582 | 03/1965 | Belpedio | 222/473 |
| 3317092 | 05/1967 | Jursdek | 222/402.13 |
| 3967763 | 07/1976 | Focht | 222/402.15 |
| 4432474 | 02/1984 | Hutchinson | 222/402.15 |
| 4449647 | 05/1984 | Reed | 222/153 |
| 5323937 | 06/1994 | Brody | 222/402.11 |
| 5992707 | 11/1999 | Galchuk | 222/402.13 |
| 5992708 | 11/1999 | Galchuk | 222/402.13 |
| 6016938 | 01/2000 | Elchorst | 222/402.15 |

STATEMENT REGARDING FEDERALLY SPONSORED RESEARCH OR DEVELOPMENT

Not Applicable

REFERENCE TO A MICROFICHE APPENDIX

Not Applicable

BACKGROUND

This invention relates to disposable actuators to be attached to aerosol spray cans. Conventional aerosol spray cans of various sizes generally operate by depressing a button type valve nozzle, situated of the top of the can, using the forefinger of the hand grasping the can. The position of the nozzle causes the user to place the forefinger in an awkward and somewhat tiring position and many times spray exhaust gets onto the fingers of the user due to the close proximity of the fingers to the spray exhaust.

Several types of aerosol cans are provided with a cap covering the spray nozzle for safety and shipping concerns. These caps require removal by twisting or prying with an external tool, such as a small slotted screwdriver. A search for a suitable tool to remove the cap from a spray can is sometimes a time consuming task.

It is known in the prior art that hand held actuation devices, made in the configuration of a pistol grip with trigger mechanism, have been patented and some are commercially available. These devices are cumbersome to attach to the spray cans, bulky, expensive to manufacture, and not readily disposable. No actuators were found that provide a means of removing the cap from aerosol spray cans.

BRIEF SUMMARY OF THE INVENTION

The purpose of this invention is to provide an inexpensive disposable actuator that may be readily attached to a variety of spray cans. The actuator provides a mechanical leverage enabling the user to use less force to initiate spray action while the handle of the actuator, being positioned approximately perpendicular to the direction of the spray exhaust, keeps fingers away from the path of the spray exhaust. The end of the actuator handle is narrowed to form a tool, much like a slotted screwdriver, which is effective in removing the cap on an aerosol spray can when twisted or used as a pry.

The actuator utilizes a toe, as a pivot point, to engage the inside recess of the cup rim bead of the spray can, and a heel portion that extends and slides against the valve stem mount. The body and handle of the actuator extend upward from the toe and heel to above the top of the spray nozzle with the body of the actuator having a protrusion that contacts the top of the spray nozzle. The handle of the actuator is curved, formed with a recess for the finger of the user, and is terminated above the top outer wall seam of the can.

The actuator is formed as a single piece and is small enough to be attached on the spray can or cap. The cost of producing the actuator in quantity is low, making it practical for use as a disposable item.

The actuator toe-heel portion is shown in cross-section.

Figure 2:
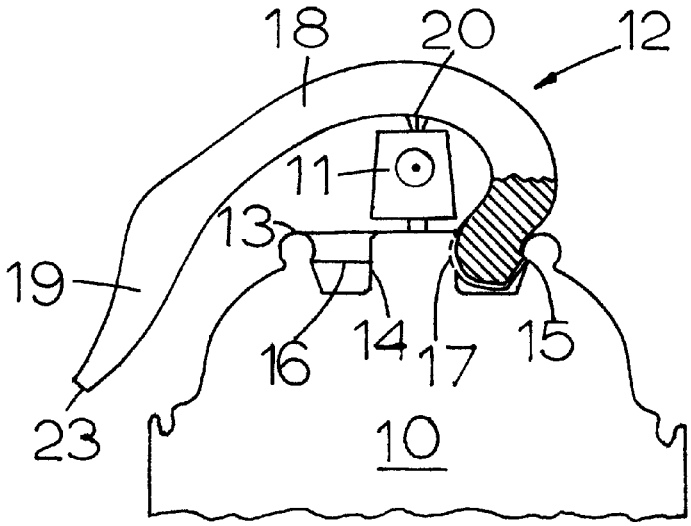
FIG. 2 A front view showing an outline of the spray can taken along lines 2—2.
Figure 3:
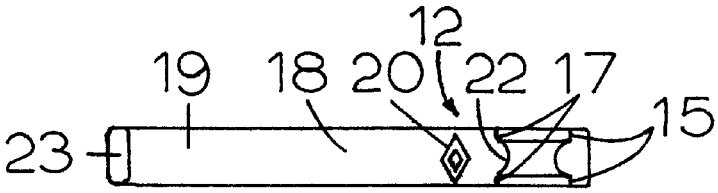

FIG. 3 A bottom view of the actuator as shown in FIG. 2.

Figure 4:
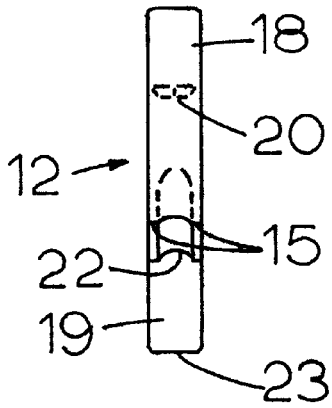

FIG. 4 An end view of the actuator.

DETAILED DESCRIPTION OF THE INVENTION

Figure 1:
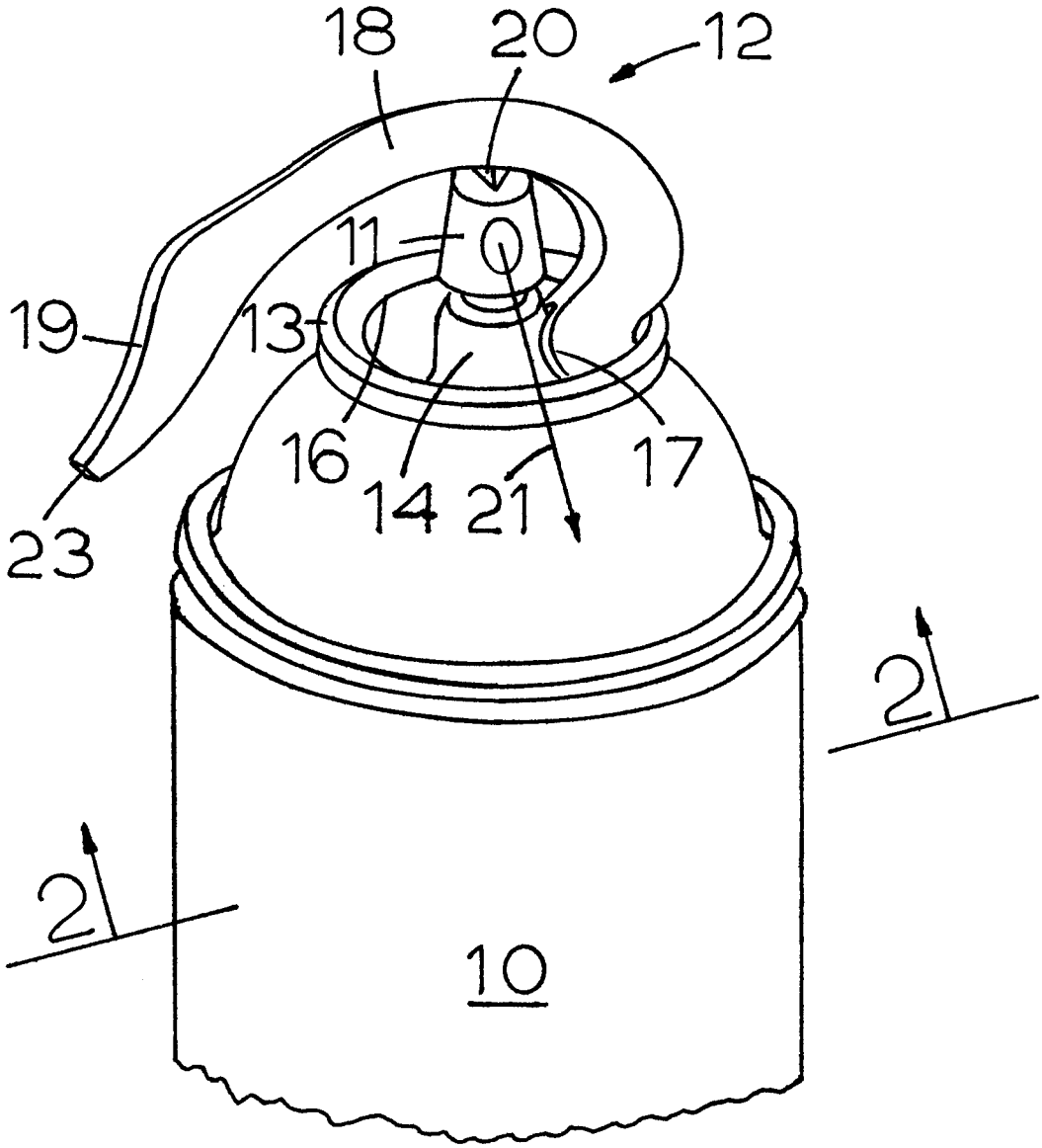
FIG. 1 A perspective view illustrating the actuator mounted and aligned on a spay can.

Referring to the drawings, FIG. 1–FIG. 2 showing an aerosol spray can 10 having a push button spray nozzle 11 with the actuator 12 attache general type have a cup rim bead 13 surrounding the valve stem mounted A common type of spray nozzle 11 is shown attached to the valve stem mount 14. The actuator 12 is of a one piece, injection molded, construction using PVC, hi-density polyethylene or similar material. Attachment of the actuator 12 to the spray can 10 is by rocking the toe 15 (pivot point) into contact with the inside recess 16 of the cup rim bead 13 with the heel 17 sliding against the valve stem mount 14. The body 18 and handle 19 of the actuator 12 extend upward and over the spray nozzle 11, the body 18 having a diamond shaped protrusion 20 which contacts the top of the spray nozzle 11. The handle 19 is positioned on the spray can 10 to be approximately perpendicular to the direction of the spray exhaust 21. Depressing the handle 9 with the forefinger or thumb of the hand grasping the spray can 10, causes the toe 15 to pivot in the inside recess 16 of the cup rim bead 13 and the heel 47 to slide against the valve stem mount 14. The diamond shaped protrusion 4 then depresses the spray nozzle creating a spray exhaust 21

Drawing FIG. 3 shows the diamond shaped protrusion 20 that contacts the top of the spray nozzle 11. It should be noted that specific types of spray nozzles require an adaptation of the activators 12, other than the diamond shaped protrusion 20, to be functional. Drawings FIG. 3–FIG. 4 show a channel 22 that extends from toe 15 to heel 47 of the actuator 12. The channel 2 creates dual contact points on the toe 15, which contact the inside recess 16 of the cup rim bead 13 and on the heel 17 which contacts the valve stem mount 14. The dual contact points of the toe a and heel 17 resiliently flex during insertion and operation of the actuator 12 thereby positioning the diamond shaped protrusion 20 on the top of the spray nozzle 11.

The handle of the actuator a is curved and formed to conform to the forefinger or thumb of the user. The handle end 23 may be inserted into an appropriate opening in the cap (not shown) of a spray can with the cap being removed from the spray can by twisting or prying with the actuator handle end 23.

What I claim for my invention is:

1. An actuator device, for controlling dispensing of material from an aerosol can having an annular cup rim bead surrounding a valve stem mount and a top mounted push button spray nozzle, said actuator device being positionable on the aerosol can such that an actuator body and a handle of the actuator device are oriented approximately perpendicular to a direction of discharge from the spray nozzle, said actuator device comprising:

a toe for engaging an inside groove recess of the annular cup rim bead, said toe being an axis for a heel, said heel having a defined radius, formed to engage and slide against the valve stem mount;

wherein the actuator body has a protrusion formed to contact a recess in a top of the spray nozzle and extending from the toe and the heel such that, when the actuator device is mounted on the aerosol can, the actuator body is positionable above the spray nozzle; and wherein the handle is curved and formed as a lever with a recess for the finger or thumb of a user, said handle extending from the actuator body such that, when the actuator device is mounted on the aerosol can, the handle terminates above a top outer wall seam of the aerosol can.

2. An actuator body as set forth in claim 1, wherein a middle portion of the toe thickness is channeled to form dual pivot points for engaging the inside groove recess.

3. An actuator body as set forth in claim 1, wherein a middle portion of the heel thickness is channeled for establishing a resiliently flexible dual engagement of a heel perimeter radius with the valve stem mount.

4. An actuator body as set forth in claim 1, wherein the protrusion is formed with sufficient extension from the actuator body such that, when the actuator device is mounted on the aerosol can, only an end of the protrusion contacts the top of the spray nozzle.

5. An actuator body as set forth in claim 1, wherein the protrusion has a width and a length such that, when the actuator device is mounted on the aerosol can, the protrusion may freely enter the recess in the top of the spray nozzle said protrusion being formed in a diamond shape and being positionable such that a length of the diamond shape is perpendicular to a length of the actuator.

6. An actuator body as set forth in claim 1, wherein an end of the handle is substantially narrow in thickness and is formed as a pry tool.

* * * * *